US008424853B2

(12) United States Patent
Wenckel et al.

(10) Patent No.: US 8,424,853 B2
(45) Date of Patent: Apr. 23, 2013

(54) ACTUATING DEVICE FOR A CHOKE VALVE

(75) Inventors: Mathias Wenckel, Hamburg (DE); Carsten Ziegs, Hamburg (DE)

(73) Assignee: Dolmar GmbH, Hamburg (DE)

( * ) Notice: Subject to any disclaimer, the term of this patent is extended or adjusted under 35 U.S.C. 154(b) by 528 days.

(21) Appl. No.: 12/591,444

(22) Filed: Nov. 19, 2009

(65) Prior Publication Data

US 2010/0181689 A1 Jul. 22, 2010

(30) Foreign Application Priority Data

Jan. 22, 2009 (DE) ..... 20 2009 000 832 U

(51) Int. Cl.
*F02M 1/02* (2006.01)

(52) U.S. Cl.
USPC ..... 261/64.3; 261/64.6

(58) Field of Classification Search ..... 261/64.1, 261/64.3, 64.6
See application file for complete search history.

(56) References Cited

U.S. PATENT DOCUMENTS

| | | | | | |
|---|---|---|---|---|---|
| 2,982,275 | A * | 5/1961 | Doman et al. | ..... | 123/198 DC |
| 3,886,241 | A * | 5/1975 | Schubeck | ..... | 261/39.3 |
| 4,307,042 | A * | 12/1981 | Berich | ..... | 261/52 |
| 4,788,014 | A * | 11/1988 | Kanno | ..... | 261/39.2 |
| 5,215,049 | A * | 6/1993 | Wolf | ..... | 123/179.18 |
| 5,693,264 | A * | 12/1997 | Fricke | ..... | 261/64.6 |
| 6,641,118 | B2 * | 11/2003 | Schliemann | ..... | 261/52 |
| 7,404,546 | B2 * | 7/2008 | Prager et al. | ..... | 261/52 |
| 7,427,057 | B1 * | 9/2008 | Kampman et al. | ..... | 261/52 |
| 2003/0075132 | A1 * | 4/2003 | Ohsawa et al. | ..... | 123/179.18 |
| 2006/0138684 | A1 | 6/2006 | Prager et al. | | |
| 2008/0191369 | A1 * | 8/2008 | Reynolds et al. | ..... | 261/64.1 |

FOREIGN PATENT DOCUMENTS

| | | | | |
|---|---|---|---|---|
| DE | 10 2004 063 197 | A1 | 7/2006 | |
| JP | 53-139022 | A * | 12/1978 | ..... 261/64.1 |
| JP | A-60-88852 | | 5/1985 | |
| JP | A-2003-49715 | | 2/2003 | |

OTHER PUBLICATIONS

German Search Report issued in German Patent Application No. 20 2009 000 832.0 on May 6, 2009. (with English translation).

* cited by examiner

*Primary Examiner* — Richard L Chiesa
(74) *Attorney, Agent, or Firm* — Oliff & Berridge, PLC

(57) ABSTRACT

In order to provide an actuating device for a choke valve of a carburetor for motorized equipment, in particular a cut-off grinder, wherein the choke valve is movable between at least a closed position and an open position by an operating element via a mechanical coupling from the operating element to the choke valve, which overcomes the disadvantages of the prior art, it is proposed that the mechanical coupling has a separating arrangement which is in operative connection with the motorized equipment such that the mechanical coupling between the operating element and the choke valve can be interrupted or respectively closed as a function of different operating states of the motorized equipment.

18 Claims, 3 Drawing Sheets

ACTUATING DEVICE FOR A CHOKE VALVE

Figure 1A:
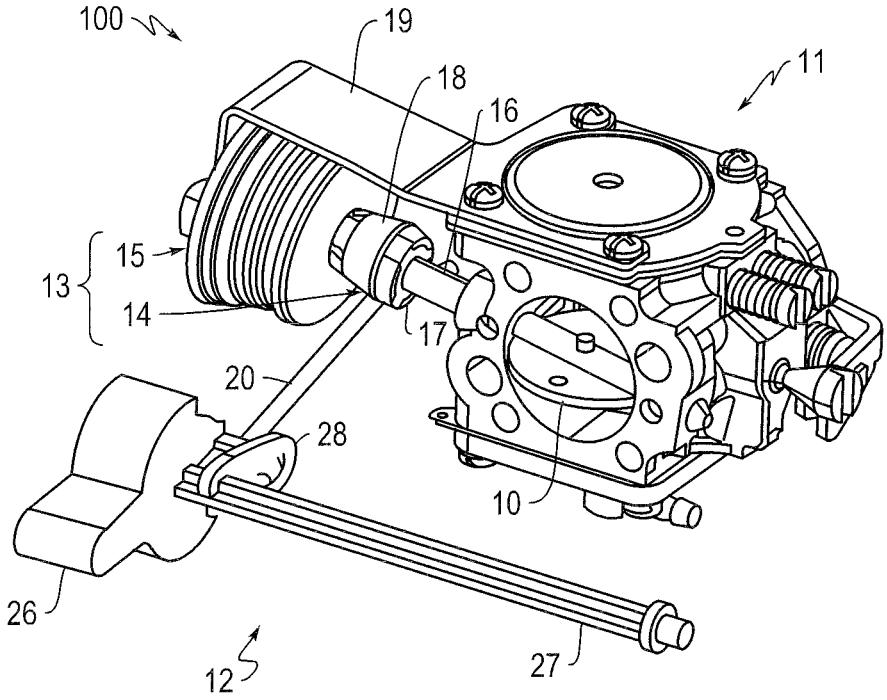

The present invention relates to an actuating device for a choke valve of a carburetor for motorized equipment, in particular a cut-off grinder, in which the choke valve is movable by an operating element via a mechanical coupling from the operating element to the choke valve between a closed position and an open position.

Motorized equipment of the type which is of interest here relate to hand-held small motorized equipment such as chain saws, lawn trimmers, cut-off grinders and suchlike. The motors of such motorized equipment have a carburetor which provides the motor with a combustible mixture of air and fuel. When starting a cold motor, the mixture must be enriched, in order to set the motor in operation in particular in a cold state. Carburetors operate with an underpressure, which occurs through constriction of flow of the air which is drawn in, wherein through the underpressure fuel is drawn in which admixes itself with the drawn in air.

A carburetor has a throttle valve and a choke valve, wherein a closed choke valve brings about a stronger underpressure, because in the closed position of the choke valve a stronger underpressure is produced at the site of the fuel provision. As a result, a more strongly enriched mixture is produced. When the operating temperature of the motor rises, the choke valve can be transferred from the closed position into the open position, and the operation of the motorized equipment is maintained.

It is desirable that at the starting of the motorized equipment the gas lever can be arrested in the half-gas position, in order to carry out a starting process with a closed choke valve. In operation or respectively after completion of the starting process, it should not be possible, however, to arrest the gas lever in the half-gas position, whilst the choke valve remains in the open position.

It is therefore the object of the present invention to provide an actuating device for a choke valve of a carburetor for motorized equipment, which overcomes the previously mentioned disadvantages.

This problem is solved by an actuating device according to the introductory clause of claim 1 in connection with the characterizing features. Advantageous further developments of the inventions are indicated in the dependent claims.

The invention includes the technical teaching that the mechanical coupling from the operating element to the choke valve has a separating arrangement which is in operative connection with the motorized equipment such that the mechanical coupling between the operating element and the choke valve can be interrupted or closed as a function of different operating states of the motorized equipment.

By the separating arrangement according to the invention, within the mechanical coupling between the operating element and the choke valve, it is achieved that after the starting up of the motorized equipment, the mechanical coupling is automatically interrupted. For this, the separating arrangement is in operative connection with the motorized equipment so that the starting up of the motorized equipment activates the separating arrangement. Through the activation of the separating arrangement, the mechanical coupling between the operating element and the choke valve is separated. In addition, the choke valve can be transferred into the open position again by pre-stressing in the movement direction to the open position, and then remains in this position until the motorized equipment is switched off again. In addition, the throttle valve can be transferred here automatically from half-gas to idling. This leads to a rotation speed prevailing after the termination of the starting process of the motorized equipment, which does not effect a starting up of the working means, for example of the saw chain. Mostly, a centrifugal clutch is situated between the motor and the working means of the motorized equipment, which clutch only engages after a rotation speed of the motor which lies above the idling speed. As a result, the risk is avoided that the saw chain, the cutting wheel or suchlike is unintentionally set in motion when the motorized equipment is started.

According to an advantageous embodiment, the operative connection between the separating arrangement and the motorized equipment is formed by an electric system. The electric system can be activated here by the ignition current of the motorized equipment. A measurement takes place here, to the effect that only on reaching the idling speed and the current generation connected therewith by the generator, does the electric system respond, so that during the starting phase and the current generation connected therewith by the generator, the electric system is not yet activated. It is also possible that the electric system is activated by an oscillation or vibration sensor, which is arranged on the motorized equipment. In this case, a sufficient voltage is present at the electric system, with the system then being activated by the oscillation and/or vibration sensor when these sensors detect a rotation speed in the range of the idling speed or respectively above the idling speed.

Preferably, provision is made that the separating arrangement comprises a coupling and an electric actuator, wherein the coupling is able to be actuated by means of the actuator between an engaged position and a disengaged position. The electric actuator is then activated by the electric system when the separation of the mechanical coupling is to take place between the operating element and the choke valve.

According to a further advantageous embodiment, the operative connection between the separating arrangement and the motorized equipment is formed by an underpressure system. The separating arrangement can have a coupling and an underpressure actuator, wherein the coupling is able to be actuated by means of the underpressure actuator at least between an engaged position and a disengaged position. The underpressure actuator is activated by the underpressure in the underpressure system. The activation of the underpressure actuator and consequently the separation of the mechanical coupling between the operating element and the choke valve takes place without intervention of the operator of the motorized equipment. Independently of the operating state of the motorized equipment, the choke valve is consequently always in the open position when the motor is in operation.

A piece of motorized equipment has an intake air tract in which at least after the air filter an underpressure prevails. The underpressure system can comprise a connecting line between the intake air tract and the underpressure actuator. When the motorized equipment starts up, an underpressure forms in the crankcase and in the intake region. As a rule, a stronger underpressure prevails here in the crankcase. Preferably, therefore, the underpressure in the crankcase is used. This underpressure is sufficient to activate the underpressure actuator, whereby the coupling is transferred from the engaged position into the disengaged position. The underpressure actuator can preferably be constructed as a bellows which has at least one underpressure connection and contracts on application of an underpressure, in order to transfer the coupling from the engaged position into the disengaged position.

In addition, the underpressure actuator or the electric actuator can have a setting piston which runs in a cup-like cylinder. Such an embodiment with a setting piston can also produce a movement of the setting piston on application of an underpressure at the underpressure connection, in order to transfer the coupling from the engaged position into the disengaged position. As soon as the disengaged position is reached, the choke valve is freely movable, with a spring being provided if applicable, in order to pre-stress the choke valve in the direction of movement to the open position. Through the free rotatability of the choke valve in the disengaged position of the coupling, the latter moves immediately into the open position.

The choke valve has a choke valve shaft, by which the choke valve is rotatably mounted in the carburetor, with the movement of the choke valve taking place by rotation of the choke valve shaft between a closed position and an open position. The choke valve can be embodied as a round, plate-shaped element and can be arranged in a cylindrical flow cross-section. In the open position of the choke valve, the latter is aligned parallel to the flow, whereas the choke valve in its closed position closes the cylindrical flow cross-section. The operating element is arranged outside the body of the carburetor, and for operating is guided at least partially out from the housing of the motorized equipment.

The mechanical coupling between the operating element and the choke valve can comprise a coupling rod which is embodied for articulation of the choke valve shaft, and sets the choke valve shaft in rotation. The operating element can preferably likewise carry out a rotary movement, which is initiated therein by the operator. The coupling rod transfers the rotary movement of the operating element to the choke valve shaft in order to likewise set the latter in rotary movement. Therefore, every possible arrangement of the separating arrangement is possible between the operating element and the choke valve, in order to uncouple an operating part of the operating element from the choke valve.

The coupling of the separating arrangement can have a first coupling part which is connected with the choke valve shaft, with a second coupling part in addition being connected with the underpressure actuator or with the electric actuator. When the underpressure actuator or the electric actuator is activated, then the first coupling part can be separated from the second coupling part, by the second coupling part being moved away from the first coupling part, and the choke valve shaft is independent in rotation direction from the movement of the coupling rod, so that the pretensioning spring transfers the choke valve into the open position. When the motorized equipment is switched off, the underpressure in the underpressure system also decreases again. The underpressure actuator or the electric actuator can comprise a restoring spring, which transfers it again into the position in which the coupling is engaged. Consequently, the choke valve can be transferred into the closed position again for the next start-up of the motorized equipment by means of the operating element, because the mechanical coupling to the choke valve shaft is established again.

When the first coupling part is connected with the choke valve shaft, then the second coupling part is in an opposite arrangement on the end side with respect to the first coupling part. The second coupling part is connected with the underpressure actuator or with the electric actuator, which consequently is likewise arranged on the end side to the choke valve shaft. To receive the underpressure actuator or the electric actuator, a holding element can be provided, which has a flange-like section in order to be fastened to the body of the carburetor. The holding element has an angled region which arranges a first part of the underpressure actuator or of the electric actuator fixedly to the body of the carburetor. A second part of the underpressure actuator or of the electric actuator is movable relative to the first part, with the second part of the underpressure actuator or of the electric actuator being able to be connected with the second coupling part. When an underpressure is produced in the underpressure actuator or in the electric actuator, then the distance of the first and second part of the underpressure actuator or of the electric actuator is reduced, and the second coupling part can be moved relative to the first coupling part.

The coupling can be embodied as a claw coupling, with the claws of the first coupling part engaging in a form-fitting manner into the claws of the second coupling part, when the coupling is transferred into the engaged position. A further possible embodiment of the coupling can be formed by a friction coupling, wherein the friction surfaces can be pressed onto each other by the restoring spring. Only on activation of the underpressure actuator or of the electric actuator are the friction surfaces separated from each other, and the choke valve is movable with the choke valve shaft independently of the position of the operating element.

In addition to the receiving of the separating arrangement with the underpressure actuator or with the electric actuator and at least one coupling part on a holding element, according to a further advantageous embodiment, the separating arrangement can also be held directly on the choke valve shaft itself. For this, a reception tube can be provided, which is rotatably arranged on the body of the carburetor and runs at least partially through the choke valve shaft. By means of the reception tube, the separating arrangement with the underpressure actuator or with the electric actuator and at least one part of the coupling is held on the body of the carburetor. The reception tube can be articulated here by the coupling rod at least partially to carry out a rotary movement, with the coupling being arranged between the reception tube and the choke valve shaft. The choke valve shaft and the reception tube run concentrically, wherein with the coupling engaged, the rotary movement of the reception tube is transferred to the choke valve shaft and these rotate likewise, whereas when the coupling is disengaged, the reception tube is freely rotatable without transferring the rotary movement to the choke valve shaft.

According to a still further embodiment, the separating arrangement with the underpressure actuator or respectively with the electric actuator and the coupling can be held in the operating element itself or can be embodied jointly with it. The operating element can be formed as a handle, in which the separating arrangement is integrated on the inside. When the manually operable part of the operating element is moved, then the movement is not transferred to the coupling rod, when underpressure is applied at the underpressure actuator or when voltage is applied at the electric actuator, and this transfers the coupling into the disengaged position. For this, the underpressure connection or respectively the voltage connection is provided on the operating element.

Figure 1B:
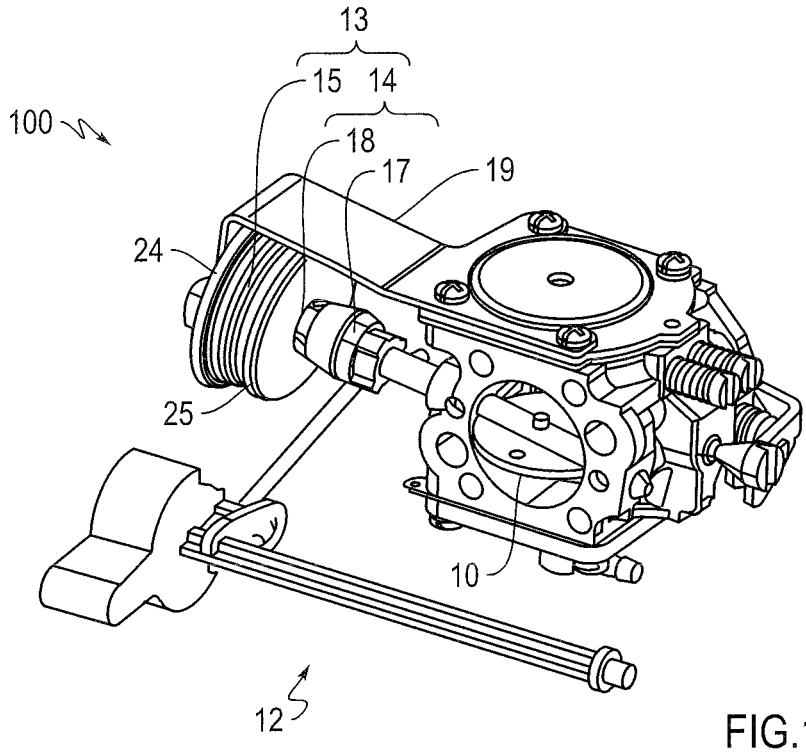
Figure 2:
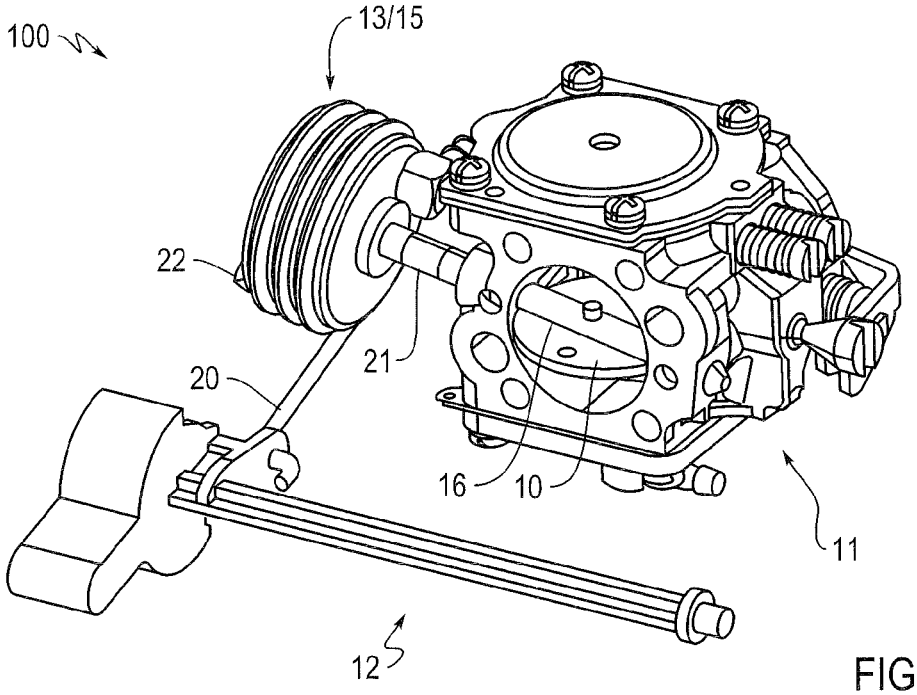
Figure 3:
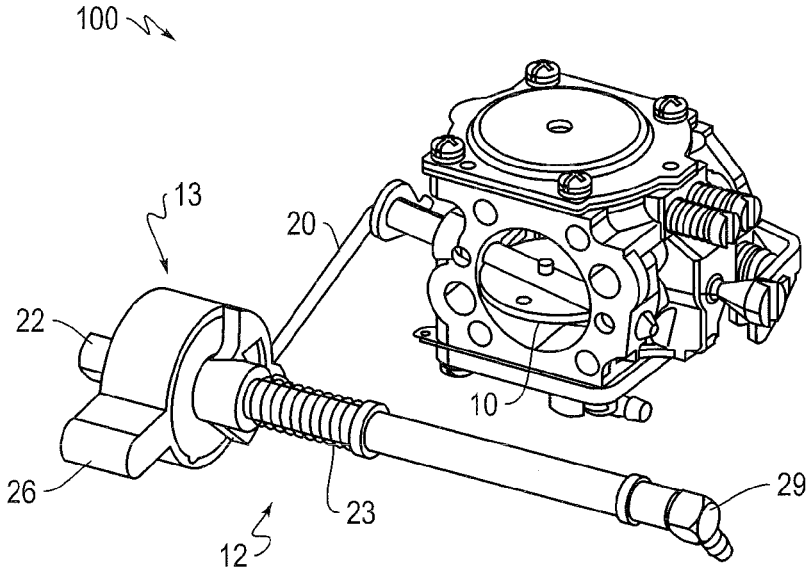
Figure 4:
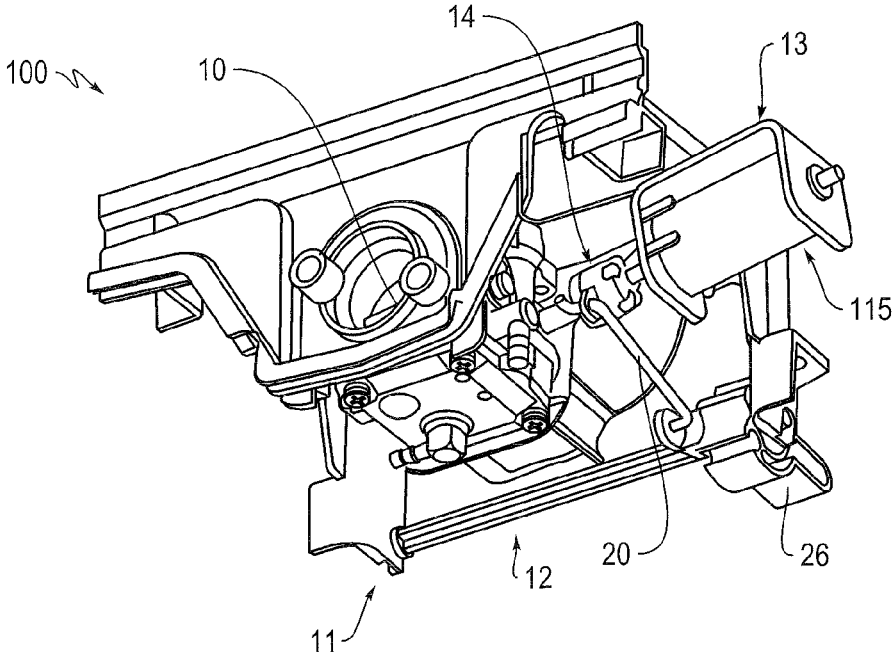

Further steps improving the invention are illustrated in further detail below together with the description of a preferred example embodiment of the invention, by means of the figures, showing in purely diagrammatic representation:

FIG. 1A a first example embodiment of an actuating device with a separating arrangement, which is arranged by a holding element on the body of the carburetor, wherein the coupling cooperates directly with the choke valve shaft and is shown in the engaged position, FIG. 1B the example embodiment according to FIG. 1A, wherein the separating arrangement is activated, so that the bellows is contracted and the coupling is shown in the disengaged position, FIG. 2 a further example embodiment of the actuating device, wherein the separating arrangement is arranged via a reception tube on the body of the carburetor, FIG. 3 a further example embodiment of the actuating device, wherein the separating arrangement is integrated in the operating element or is embodied jointly with it, and FIG. 4+5 a further example embodiment of the actuating device, wherein the actuator is embodied as an electric actuator.

FIG. 1A shows in a perspective view an example embodiment of the actuating device 100 according to the invention for a choke valve 10 of a carburetor 11, as is used for a piece of motorized equipment. The actuating device 100 can be operated manually via an operating element 12, wherein the operating element 12 can have a handle 26 which is arranged on the end side on a shaft 27. The operating element 12 can be rotatably mounted in the housing of the motorized equipment via the shaft 27, wherein the handle 26 can be situated for operation externally on the housing of the motorized equipment.

The operating element 12 further comprises a lever 28, on which a coupling rod 20 is connected at the end side. When the operating element 12 is rotated via the handle 26 along the axis of the shaft 27, the coupling rod 20 carries out substantially a longitudinal movement. The coupling rod 20 extends in the direction to a second coupling part 18, which together with a first coupling part 17 forms the coupling 14. The second coupling part 18 can carry out a rotary movement by articulation of the coupling rod 20.

The coupling 14 is shown in the engaged state, so that both the first and also the second coupling part 17 and 18 carry out a shared rotary movement. The first coupling part 17 is connected with a choke valve shaft 16 so as to be locked against relative rotation, with the choke valve 10 being held on the choke valve shaft 16 so as to be locked against relative rotation. This produces a mechanical coupling between the operating element 12 and the choke valve 10, so that the choke valve 10 can be rotated between a closed position and an open position when the handle 26 of the operating element 12 is rotated manually.

The mechanical coupling between the operating element 12 and the choke valve 10 can be separated by means of a separating arrangement 13, which in addition to the coupling 14 is additionally formed from an underpressure actuator 15 in the form of a bellows 15 and is arranged with the holding element 19 fixedly on the carburetor 11. The separation of the mechanical coupling takes place by separation of the first coupling part 17 from the second coupling part 18. This is made possible by an underpressure which can be produced in the bellows 15. Here, the second coupling part 18 is moved away from the first coupling part 17 in the extension direction of the choke valve shaft 16, when the bellows 15 contracts axially. This activated state of the separating arrangement 13 is shown in further detail in FIG. 1B.

FIG. 1B shows the actuating device 100 in an activated state. The separating arrangement 13 is activated by an underpressure existing onto the underpressure actuator 15. Here, the distance decreases between a first part 24 and a second part 25 of the underpressure actuator 15. The second part 25 is connected with the second coupling part 18, wherein with reduction of the distance between the second part 25 and the first part 24 of the underpressure actuator 15, the engagement of the second coupling part 18 in the first coupling part 17 is discontinued. According to a preferred embodiment, the throttle valve 10 is elastically pre-stressed in the direction of movement to the open position, so that the open position of the choke valve 10, which is now freely rotatable, persists independently of the operating position of the operating element 12.

FIG. 2 shows a further example embodiment of the actuating device 100 with a separating arrangement 13 which is arranged via a reception tube 21 directly on the body of the carburetor 11. The reception tube 21 is arranged concentrically with the choke valve shaft 16 on the carburetor 11, so that the choke valve shaft 16 extends at least partially through the reception tube 21. The reception tube 21 has a rotatable part on which the underpressure actuator 15 is flange-mounted on the end side. The rotary movement in the rotatable part of the reception tube 21 can be initiated in the same manner via the coupling rod 20, which is movable via the operating element 12. The coupling, which is not shown in further detail, can be situated on the inside in the underpressure actuator 15. By the application of an underpressure in the underpressure actuator 15 via the underpressure connection 22, parts of the underpressure actuator 15, which are again not shown in further detail, can be moved relative to each other. Thereby, the coupling, arranged lying on the interior, is moved between the engaged position and the disengaged position. In the engaged position, the rotary movement of the reception tube 21 is transferred to the choke valve shaft 16. In the disengaged position, on the other hand, the rotary movement of the reception tube 21 can be carried out without being transferred to the choke valve shaft 16.

FIG. 3 shows a further example embodiment of the actuating device 100 with an arrangement of the separating arrangement 13 in the operating element 12. The separating arrangement 13 is held in the body of the handle 26. The separating arrangement 13 can be activated and deactivated via the underpressure connection 22. When the separating arrangement 13 is activated and the first and second coupling parts are separated from each other, a manually initiated rotary movement into the handle 26 can not be transferred to the coupling rod 20. When no underpressure is applied at the separating arrangement 13, a restoring spring 23 makes provision that the coupling parts of the coupling are engaged. In the engaged state, the rotary movement of the handle 26 can be transferred to the coupling rod 20, and the throttle valve 10 can be transferred into the closed position.

The underpressure system can be embodied as a through-flow system, so that a further underpressure connection 29 can be provided. The separating arrangement 13 with the underpressure actuator 15 can be flowed through by suction air, with the flow taking place either from the underpressure connection 22 to the underpressure connection 29 or vice versa. According to the example embodiment in FIG. 3, the underpressure connections 22 and 29 are respectively arranged on the end side on the shaft 27 of the operating element 12 and have hose reception sections, with a hose constituting a possible connection between the separating arrangement 13 and the intake air tract of the motorized equipment.

The invention is not restricted in its embodiment to the preferred example embodiment indicated above. Rather, a number of variants are conceivable, which make use of the illustrated solution also with basically differently developed embodiments. All the features and/or advantages arising from the claims, the description or the drawings, including structural details, spatial arrangements and method steps, can be essential for the invention both alone and also in the most varied of combinations. In particular, the separating arrangement 13 can also be integrated in the body of the carburetor 11 itself. The coupling can be embodied as a claw coupling, with a friction coupling with friction partners constructed flat or cone-shaped also being able to be used. The coordinate construction of the operating element 12 laterally to the carburetor 11 can also be embodied differently. For example, the operating element 12 can be connected directly with the first part 24 of the underpressure actuator 15. A rotary movement, which is initiated via the operating element 12 into the first part 24 of the underpressure actuator 15, is transferred, with the closed coupling 14, to the choke valve shaft 16, with the transfer being interrupted on an opening of the coupling 14. The coupling rod 20 can thereby be dispensed with.

Figure 5:
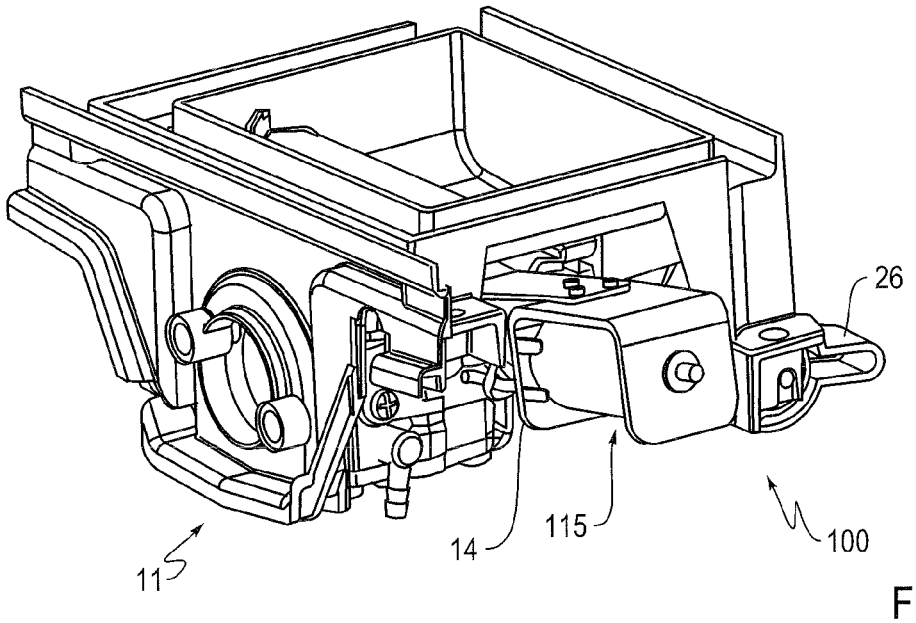

A further preferred example embodiment of the actuating device 100 according to the invention for a choke valve 10 of a carburetor 11 is illustrated in FIGS. 4 and 5. Here, the basic construction and mode of operation of this actuating device 100 corresponds to the construction and mode of operation illustrated above for FIGS. 1A and 1B, which is not referred to expressly here. Identical components are therefore also designated by identical reference numbers.

The difference consists in the configuration of the separating arrangement 13. The latter consists in the present case of an electric actuator 115 in the form for example of a magnet switch which actuates the coupling 14. The electric actuator 115 is activated here either by the ignition current of the internal combustion engine, which is not illustrated, by the current of the generator of the internal combustion engine, produced by the generator (not illustrated), or via sensors, which are not illustrated, on the internal combustion engine.

REFERENCE LIST

100 actuating device
10 choke valve
11 carburetor
12 operating element
13 separating arrangement
14 coupling
15 underpressure actuator/bellows
16 choke valve shaft
17 first coupling part
18 second coupling part
19 holding element
20 coupling rod
21 reception tube
22 underpressure connection
23 restoring spring
24 first part
25 second part
26 handle
27 shaft
28 lever
29 underpressure connection
115 electric actuator

The invention claimed is:

1. An actuating device for a choke valve of a carburetor for motorized equipment, the actuating device comprising:

an operating element; and a mechanical coupling between the operating element and the choke valve, wherein the choke valve is movable between at least a closed position and an open position by the operating element via the mechanical coupling from the operating element to the choke valve, and wherein the mechanical coupling has a separating arrangement which is in operative connection with the motorized equipment such that the mechanical coupling between the operating element and the choke valve can be interrupted or respectively closed as a function of different operating states of the motorized equipment.

2. The actuating device according to claim 1, wherein the choke valve is prestressed in a movement direction to the open position.

3. The actuating device according to claim 1, wherein after interruption of the mechanical coupling between the operating element and the choke valve, the choke valve remains in the open position.

4. The actuating device according to claim 1, wherein the operative connection between the separating arrangement and the motorized equipment has an electric system.

5. The actuating device according to claim 4, wherein the electric system is activated by an ignition current of the motorized equipment.

6. The actuating device according to claim 4, wherein the electric system is activated by an oscillation and/or vibration sensor which is arranged on the motorized equipment.

7. The actuating device according to claim 4, wherein the separating arrangement comprises a coupling and an electric actuator, with the coupling being able to be actuated by means of the electric actuator between an engaged position and a disengaged position.

8. The actuating device according to claim 1, wherein the operative connection between the separating arrangement and the motorized equipment has an underpressure system.

9. The actuating device according to claim 8, wherein the separating arrangement comprises a coupling and an underpressure actuator, with the coupling being able to be actuated by means of the underpressure actuator between an engaged position and a disengaged position.

10. The actuating device according to claim 9, wherein the motorized equipment has an intake air tract and a crankcase, wherein the underpressure system comprises at least one connecting line between the intake air tract and/or the crankcase and the underpressure actuator, and wherein the underpressure actuator transfers the coupling into the disengaged position when, on starting up of the motorized equipment, an underpressure occurs at the underpressure actuator.

11. The actuating device according to claim 1, wherein the choke valve has a choke valve shaft, by which the choke valve is rotatably mounted in the carburetor, and wherein a movement of the choke valve takes place by rotation of the choke valve shaft between the closed position and the open position.

12. The actuating device according to claim 1, wherein the separating arrangement comprises a coupling and either an underpressure actuator or an electric actuator, wherein the coupling has a first coupling part and a second coupling part, wherein the first coupling part is connected with a choke valve shaft and wherein the second coupling part is connected with the underpressure actuator or with the electric actuator.

13. The actuating device according to claim 1, wherein the separating arrangement comprises a coupling and either an underpressure actuator or an electric actuator, and wherein a holding element is provided and is arranged for a holding reception of the underpressure actuator or of the electric actuator on a body of the carburetor.

14. The actuating device according to claim 1, wherein the mechanical coupling between the operating element and the choke valve comprises a coupling rod which is embodied for an articulation of a choke valve shaft.

15. The actuating device according to claim 1, wherein a reception tube is provided, which is rotatably arranged on a body of the carburetor and through which a choke valve shaft runs at least partially, wherein the separating arrangement comprises a coupling and either an underpressure actuator or an electric actuator, and wherein the separating arrangement with the underpressure actuator or with the electric actuator and the coupling is held by the reception tube on the body of the carburetor.

16. The actuating device according to claim 15, wherein the reception tube is able to be articulated by a coupling rod to carry out an at least partial rotary movement, with the coupling being arranged between the reception tube and the choke valve shaft.

17. The actuating device according to claim 1, wherein the separating arrangement comprises a coupling and either an underpressure actuator or an electric actuator, and wherein the separating arrangement with the underpressure actuator or with the electric actuator and the coupling is held in the operating element or is embodied jointly therewith.

18. The actuating device according to claim 9, wherein the underpressure actuator is constructed as bellows, which has at least one underpressure connection and contracts on application of an underpressure, in order to transfer the coupling from the engaged position into the disengaged position.

* * * * *